United States Patent [19]

Eary, Sr.

[11] 4,455,698

[45] Jun. 26, 1984

[54] ADJUSTABLE UPPER BODY REST

[76] Inventor: George D. Eary, Sr., R4 #27 Pinecrest Dr., Chesapeake, Ohio 45619

[21] Appl. No.: 313,244

[22] Filed: Oct. 21, 1981

[51] Int. Cl.[3] ..... A47G 9/00

[52] U.S. Cl. ..... 5/436

[58] Field of Search ..... 5/431, 434–442, 5/446, 447; 269/328; 297/391

[56] References Cited

U.S. PATENT DOCUMENTS

| | | | |
|---|---|---|---|
| 3,828,377 | 8/1974 | Eary, Sr. | 5/435 |
| 3,913,155 | 10/1975 | Eary, Sr. | 5/435 |
| 3,946,452 | 3/1976 | Eary, Sr. | 5/435 |
| 4,028,754 | 6/1977 | Eary, Sr. | 5/440 |
| 4,346,488 | 7/1982 | Eary, Sr. | 5/436 |

*Primary Examiner*—Alexander Grosz

[57] ABSTRACT

An adjustable upper body rest is disclosed which is intended primarily for supporting the upper body while laying face down with the head turned to the right or left side at an angular position of approximately thirty degrees below a horizontal plane. A head support consisting of one or more rests configured to be concave lengthwise and widthwise and rotatable about a near horizontal axis and resembling an elongated dish providing open areas for the eyes, nose and mouth. Likewise, two typical shoulder supports are disclosed, the tops of which are configured in a convex manner at the end nearest to the head support and provide restful support for the shoulders while laying flat on the stomach and chest in the face down position. Said shoulder supports are each configured in a concave manner at the opposite end and while at a high or low elevation each provides a separate restful support for the user's head while laying on the right or left side. When the user is laying on the right side with the head on the right shoulder rest, the unused left shoulder rest provides a very accommodating and elevated rest for the user's left arm. Conversely, when the user is laying on the left side and using the left shoulder rest to support the head, the right shoulder rest provides a very accommodating and restful support for the user's right arm, at an elevated position if desired.

5 Claims, 13 Drawing Figures

ADJUSTABLE UPPER BODY REST

BACKGROUND OF THE INVENTION

1. Field of the Invention

This invention relates to a support for the upper part of the body. More particularly it relates to a device which enables one to lie comfortably face-down with the head to the right or left side at an angular position of approximately thirty degrees below a horizontal plane, wherein the head and shoulders are nested in a manner providing for a comfortable distribution of the upper body weight and which enables easy, unrestricted breathing in a sanitary manner through the nose or mouth. Moreover, it allows the user to lie on either the right side and shoulder or the left side and shoulder comfortably by providing two elevated rests, either one for the head and the other for the right or left arm. Either rest supports a portion of the body weight and all of the weight of the user's head thereby relieving most normal pressure on the shoulder joint while lying on either side. To change the upper body rest from a face-down mode of use to a right or left side mode of use, or to perform the reverse procedure of side use to face-down use, requires a minimum of effort and allows the user to remain undisturbed in the prone position while making either change.

Many individuals have difficulty in resting or sleeping comfortably in a face-down or side position even though they have a strong desire to do so. These types of repose may be required during surgery, in post operation recovery or due to general afflictions such as arthritis. Either mode of repose, on either side or face-down is helpful to ladies who have had their hair coiffured and wish to preserve it's beauty. In addition, sunbathers will find this invention useful. Furthermore, those users who desire to sleep or rest flat on their backs a portion of the time will find that this invention occupies an area smaller than the conventional pillow, which precludes the necessity of pushing it off of the bed to make room to stretch out flat. Alternately, for those who sleep on their back a portion of the time and wish to have a support under their head, there is provided a variety of elevation of supports to rest their head upon while on-the-back repose is enjoyed. However, documentation suggests that on-the-back repose promotes snoring while sleeping.

2. Description of Prior Art

A number of devices have been patented which are stated to enable one to lie face-down or on the right or left side in comfort. While these devices are of assistance they either do not provide the comforts for the user or they do not adjust from face-down repose configuration to the right or left side configuration as well as the reverse adjustment with such effortless simplicity.

SUMMARY OF THE INVENTION

This invention consists of a base member having adjustably attached thereto a pair of spaced apart resilient shoulder rests which may be moved laterally and longitudinally relative to each other and also relative to the head rest, allowing the distances between all of said rests to be varied as desired. The head rest is attached to the base member in a central position longitudinally, but toward the top or front width-wise, consisting of one or more sections and is removeable as well as rotatable in a limited manner about a horizontal axis. Likewise, two typical shoulder rests are disclosed, consisting of one or more sections each, the forward portions of which are configured in a convex manner at the end nearest to the head rest and provide a comfortable support for the shoulders when the user is lying in the face-down position. Said shoulder support rests are configured in a concave manner at the opposite ends. The upper body rest is prepared for lying on the right or left side very simply by moving the shoulder rest(s) toward the top of the body rest and away from the user which then instantly rises, providing suitable higher elevations for the comfortable support for the head and if desired by the user, an arm can be comfortably rested on the opposite shoulder rest at the higher elevation.

DESCRIPTION OF PREFERRED EMBODIMENTS

Figure 1:
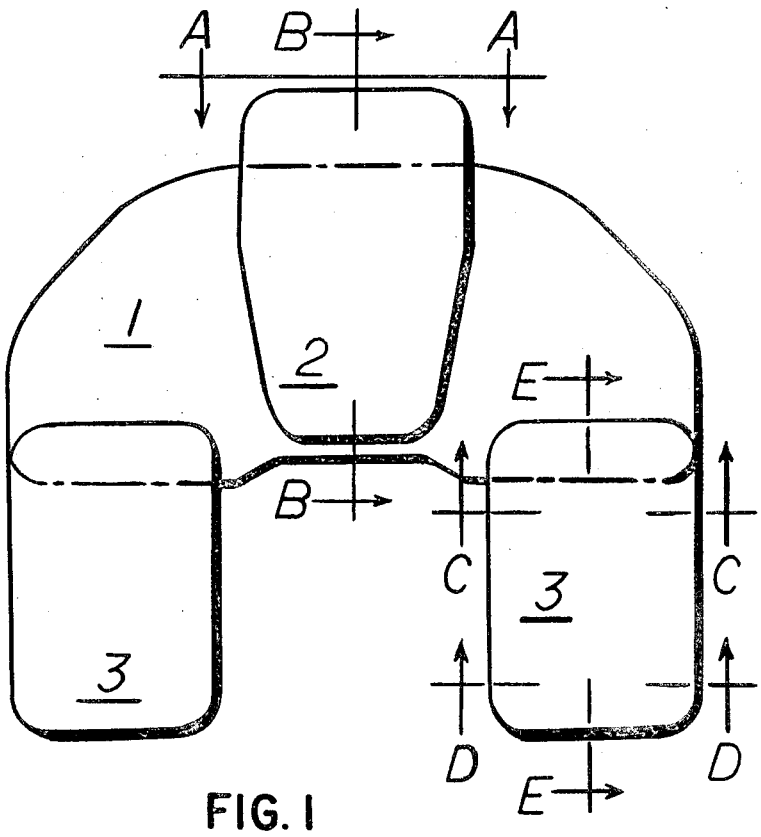
FIG. 1 is a plan view of the upper body rest as used for face-down repose.

FIG. 1 is a plan view and shows an upper body rest which has a base designated as 1 and is made of flat and relatively thin, semirigid material to serve as a support for the head and shoulder rest support members to be adjustably attached thereon and thereto. Preferable material for all base, shoulder and head rest support members 1, 5, 10, 14, 15 and 16, etc. would be one or more of the various types of plastics. Alternately, any other light weight material such as aluminum, thin particle board etc. could be used. Attached to base 1 at its rearward portion are (2) shoulder rest base members 16 and 16 which adjustably connect shoulder rests 3 and 3 to base 1 by use of two fasteners 17 and 17 shown in FIGS. 8 and 13. Near the center and top of base 1 is adjustably attached a resilient head rest identified by the number 2. Resilient materials used for rests 3, 2 and 3 are preferably a thin under layer of high density foam rubber with a thicker over lay of low density foam rubber but various densities of polyurethane foam or the like could be used as shown in FIGS. 4, 5, 6, 7 and 8. Note that head rest 2 extends beyond base 1 and provides a cushion against worrisome contact with a bed headboard or the user's body, etc.

Figure 2:
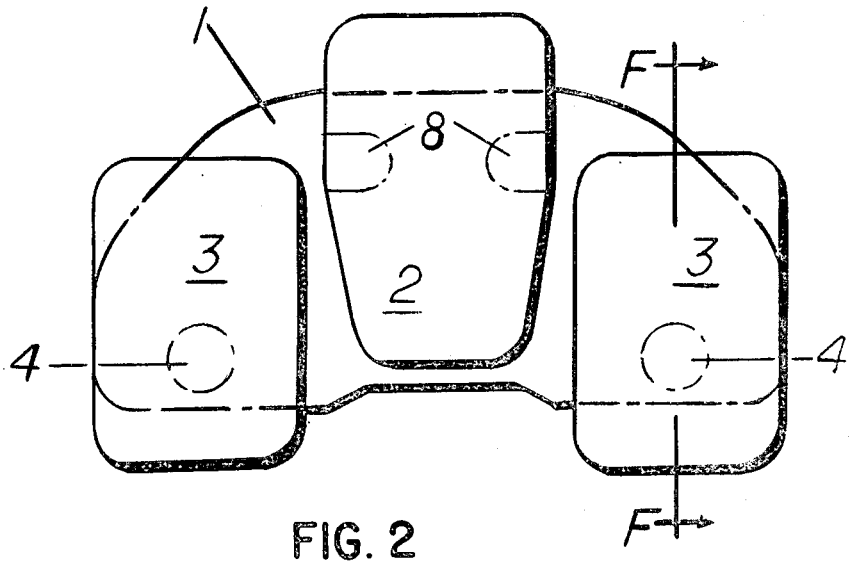
FIG. 2 is a plan view of the upper body rest as used for repose on the right or left side.
Figure 7:
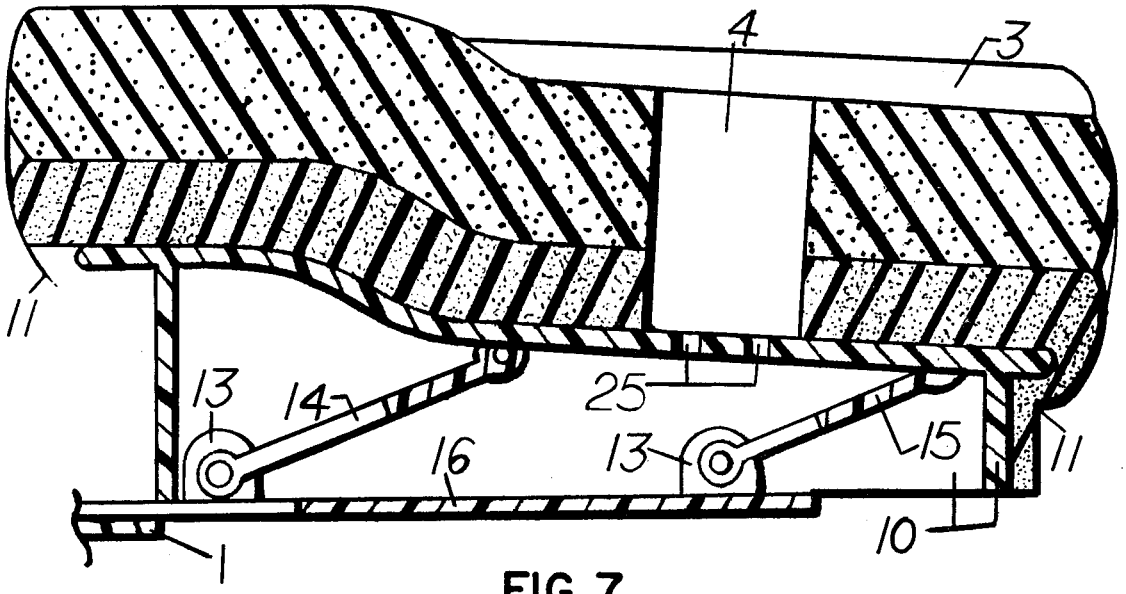
FIG. 7 is a sectional view along line E—E of FIG. 1.
Figure 8:
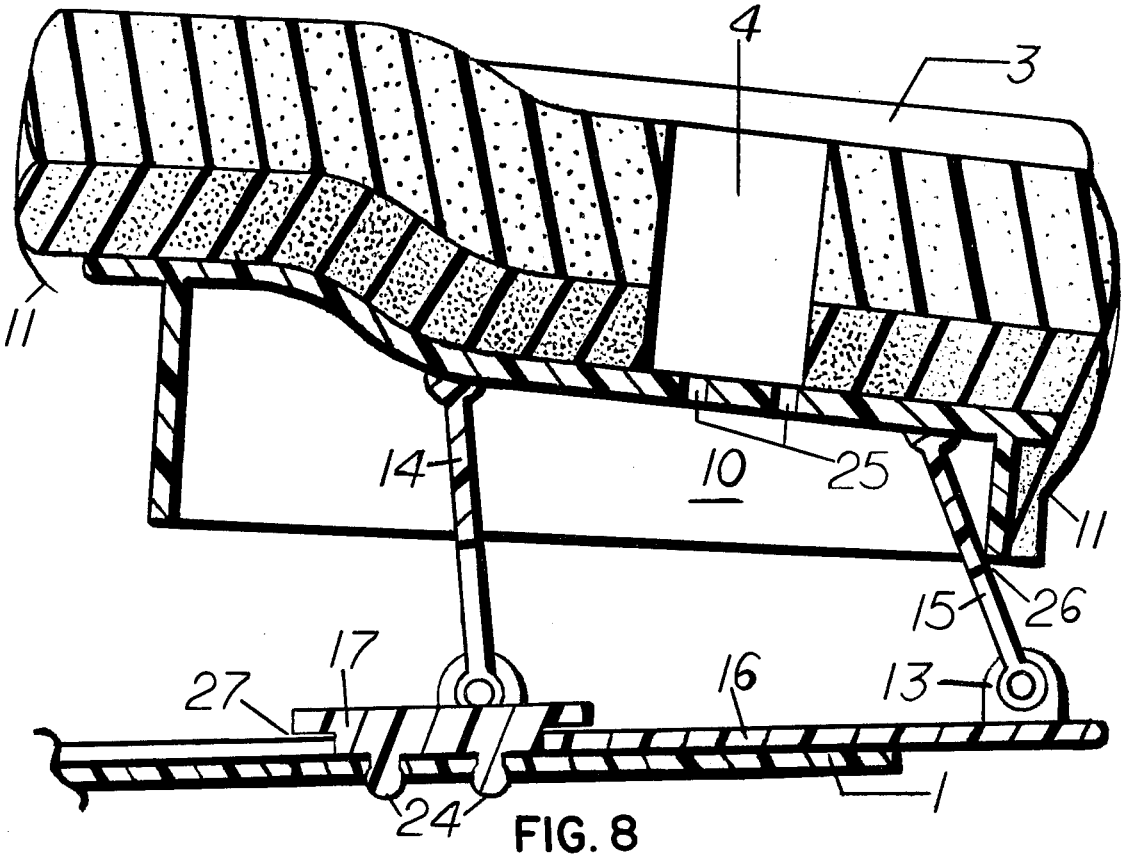
FIG. 8 is a sectional view along line F—F of FIG. 2.

FIG. 2 is a plan view of the upper body rest showing the correct relative positions of all rests as positioned when the user desires to lie on the right or left side. Openings 4, 8 and 4 shown in rests 3, 2 and 3 respectively are provided in the resilient material for better hearing capabilities of a small radio or radio speaker which may alternately be adapted to fit underneath one or more of the support forms 5, 10 or 5 which also contain a series of smaller holes to serve the same purpose and are shown in FIGS. 7 and 8 where they are identified by the number 25. Furthermore, openings identified by the number 8 eliminate any pressure on the user's eye which would otherwise result from the resilient material in the absence of the openings.

Figure 3:
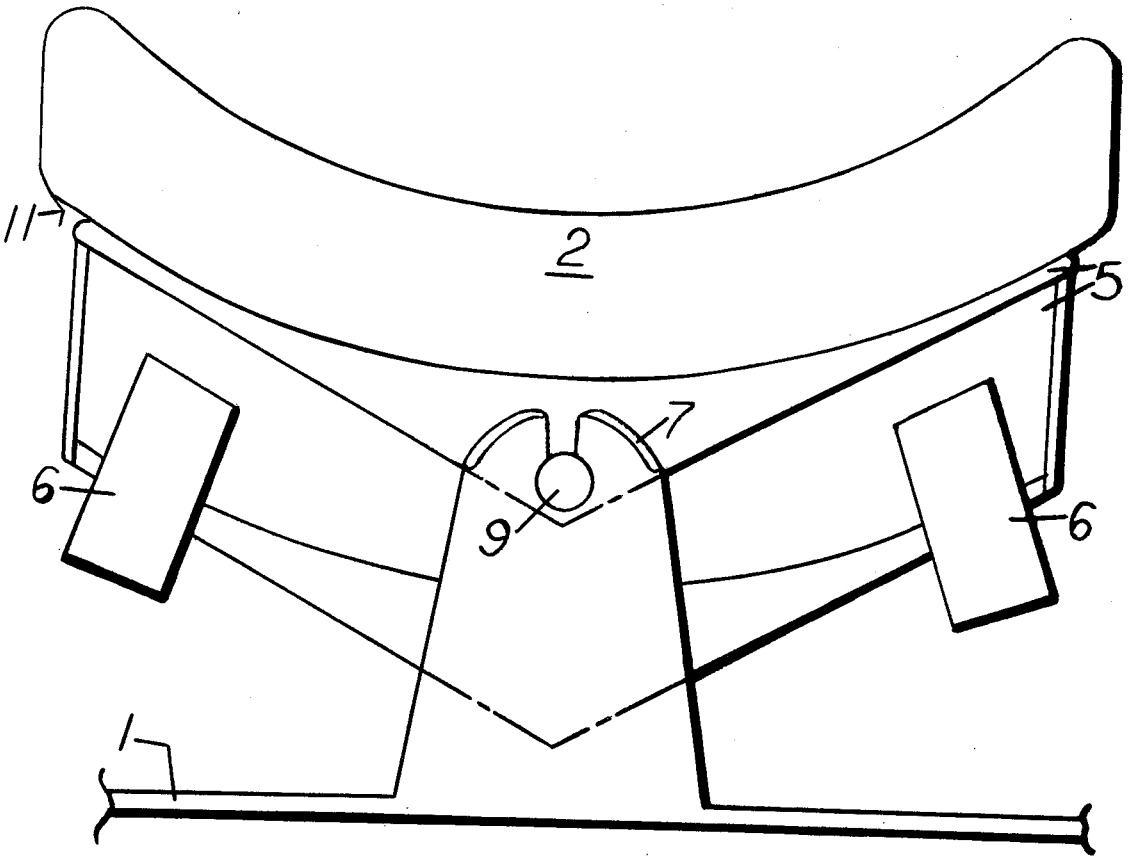
FIG. 3 is an elevation view along line A—A of FIG. 1 rotated one hundred and eighty degrees.
Figure 4:
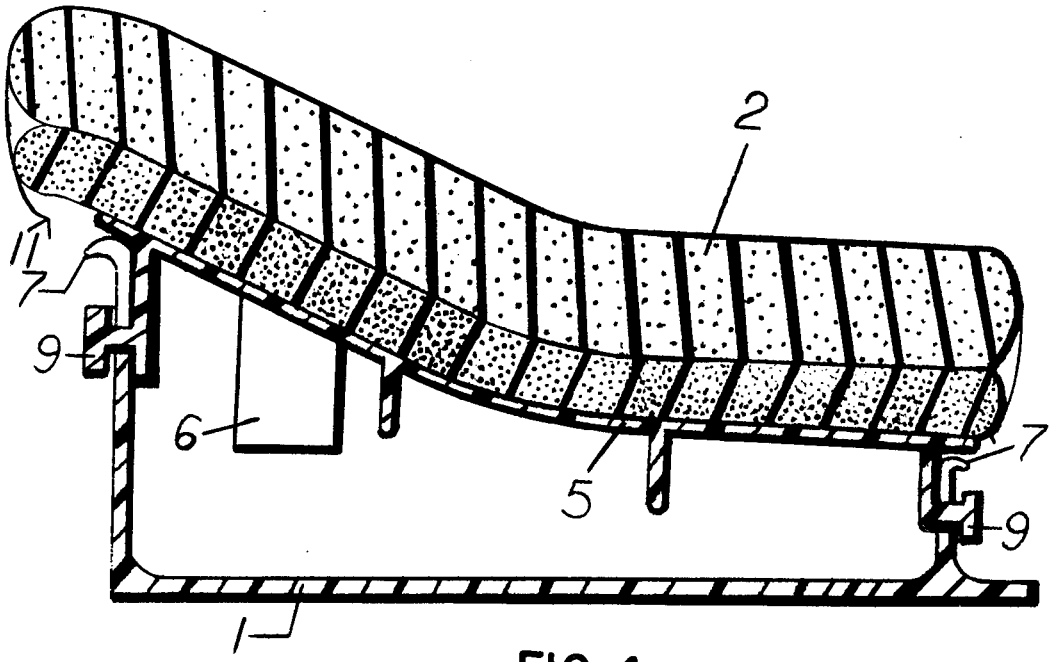
FIG. 4 is a sectional view along line B—B of FIG. 1.

FIG. 3 is an elevation view along line A-A, rotated one hundred and eighty degrees, showing rest 2 as it is supported by member 5 which is positioned in slotted portions of base 1 identified by number 7 in FIG. 3 and the numbers 7 and 7 in FIG. 4. Said slots are wider at the top and are a modified "V" shape with a circular cutout at the lower end which has a slightly larger diameter than the width of the lower end of the "V" slot. Considering FIGS. 3 and 4 together, when head rest support member 5 is forced into said slots, portions identified by the numbers 9 and 9 snap into the holes at the bottom of the "V" slots which secures head rest 2 to base 1. Said portions identified 9 and 9 are shown to be plastic pins with large heads, however, other materials such as metal screws or the like may be used. Also shown are members 6 and 6 which provide limitations of the rotation of rest 2 about the near horizontal axis along the length of rest 2 and about members 9 and 9. This arrangement allows the user to rotate rest 2 downward approximately thirty degrees toward the right or left as desired by the user when turning the face to the right or left.

FIG. 4 is a sectional view along line B—B of FIG. 1 showing the manner of attachment of head rest 2 to base 1. Also note that base 1 portions identified with numbers 7 and 7 are configured in a rounded manner so as to preclude injury to the user in the unlikely event that support 5 of rest 2 should become disengaged from base 1.

Figure 5:
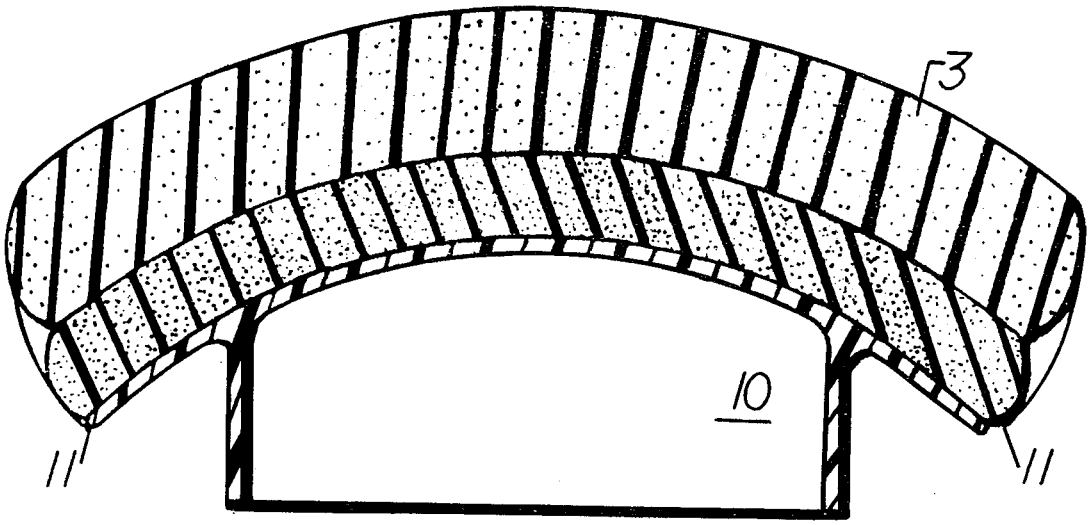
FIG. 5 is a sectional view along line C—C of FIG. 1.

FIG. 5 is a sectional view along line C—C of FIG. 1 showing the convex configuration of the top of shoulder rest 3 at the end nearest to the head rest 2. Said convex configuration is provided for approximately one third of the length of each shoulder rest 3.

Figure 6:
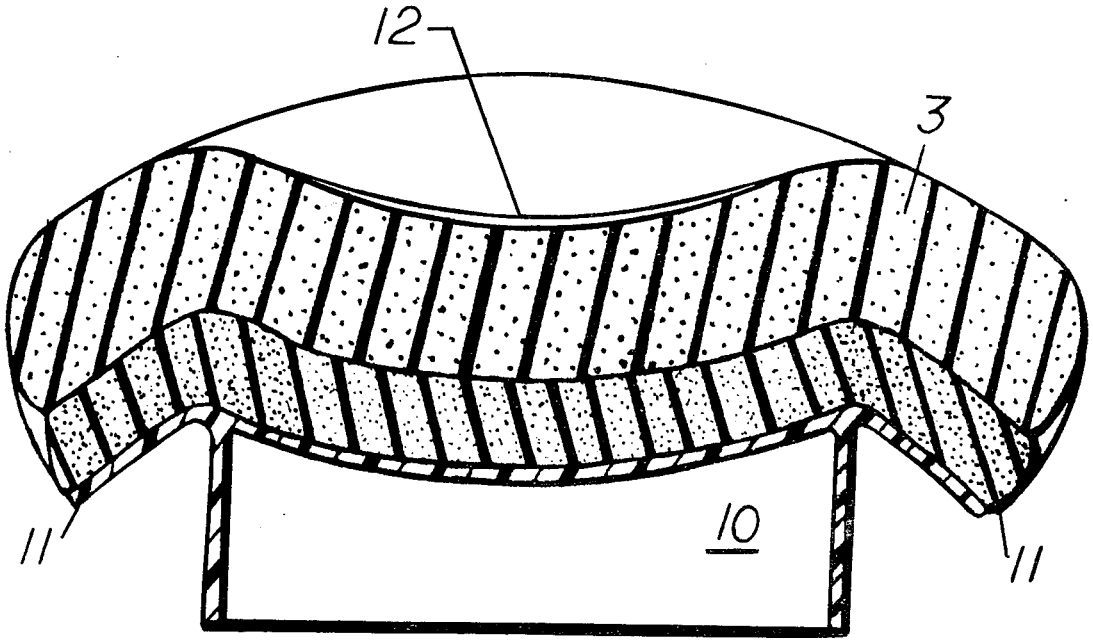
FIG. 6 is a sectional view along line D—D of FIG. 1.

FIG. 6 is a sectional view along line D—D of FIG. 1 showing the concave configuration of the top of shoulder rest 3 at the end farthest from the head rest 2. Also shown is a cover identified by the number 12 which is typical for covers of rests 3, 2 and 3. Said covers may be made of any cloth or the like and made to be form fit by elastic or the like secured to the covers at underneath points identified by the number 11 as shown in FIGS. 3, 4, 5, 6, 7 and 8. Alternately, said covers may be made completely or partially of a thin pliable plastic such as is used to cover ear protectors which are used by target shooters.

FIG. 7 is a sectional view along line E—E of FIG. 1 showing the right side shoulder rest 3 at the lowest elevation and is the proper position when the user desires to lie face-down. The higher convex area provides adequate support for the user's right shoulder. Note that the shoulder rest base member 16 extends considerably beyond the edge of body rest base member 1, which is also shown in FIG. 1. The right hand ends of members 14 and 15 are shown here to be attached to support 10 at a higher elevation than the opposite ends of members 14 and 15 where they are attached to protrusions 13 and 13. This configuration allows rest 3 to be movwed to the higher elevation shown in FIG. 8 by applying a very slight pressure at the concave end of rest 3 and without the necessity of the user to move his or her body from the face-down position. Likewise, support members 14 and 15 act as lifters or cams.

FIG. 8 is a sectional view along line F-F of FIG. 2 showing the right side shoulder rest 3 at the higher elevation which is the proper position when the user desires to lie on the right or left side. The concave area provides a nesting rest for the support of the user's head. Resilient material is recessed or omitted as noted by the number 4 and support 10 contains a series of holes as noted by the number 25, to permit the sounds from a radio or radio speaker which may be adapted to fit on the underneath side of support 10, to reach the ear of the user. Member 17 is shown as a means of attachment of shoulder rest base 16 to body rest base 1 and is secured to body base 1 by two spherical ended extensions of member 17 and identified by the number 24, which are pressed through slightly smaller, slotted holes in body rest base 1. Note that member 15 is shorter than member 14, providing an angle downward of each shoulder rest 3 which aligns with the downward angle of the user's spine when resting on either side. At a point identified by the number 26, support member 10 contacts lifter member 15 so as to stabilize rest 3 at a definite high-elevation position. Number 27 indicates a gap between shoulder rest base 16 and fastener 17 which allows shoulder rests to move freely in relation to body rest base 1.

Figure 9:
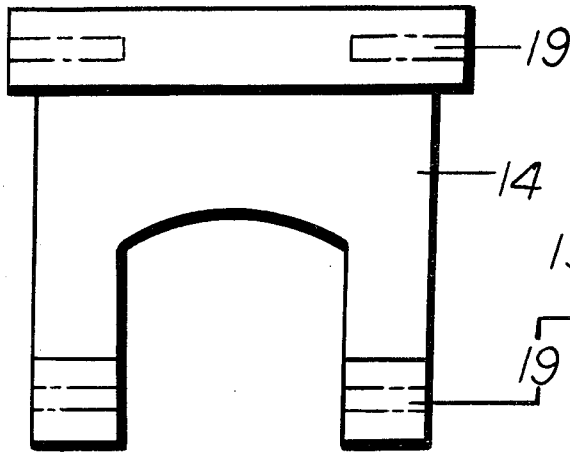
FIG. 9 is a plan view of shoulder rest 3 support member 14.
Figure 10:
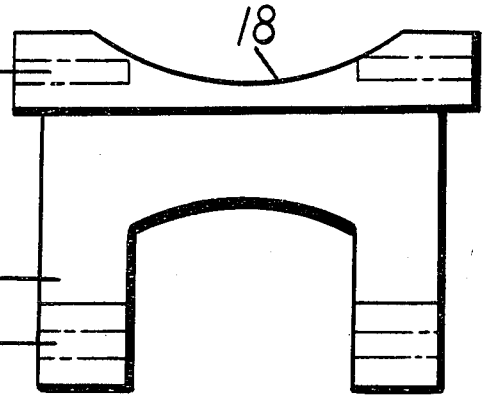
FIG. 10 is a plan view of shoulder rest 3 support member 15.

FIGS. 9 and 10 are plan views of members 14 and 15 respectively, which secure shoulder rest 3 to shoulder rest base 16 in an adjustable manner, providing the capability of positioning said rest 3 at a higher or lower elevation. Recesses in lifting members 14 and 15 are noted by numbers 19 and 19, into which pins, screws or the like are fitted through matching holes in support 10 shown in FIGS. 7 and 8 and into said holes of members 14 and 15 at the top or wider ends. Likewise, attachment of members 14 and 15 is provided at the lower ends to base 16 at protrusions noted by the number 13, shown four places in FIG. 11 and shown two places in FIGS. 7 and 8. Member 15 is recessed at the top at an area identified by the number 18 to allow clearance for the concave area of support 10 of shoulder rest 3.

Figure 11:
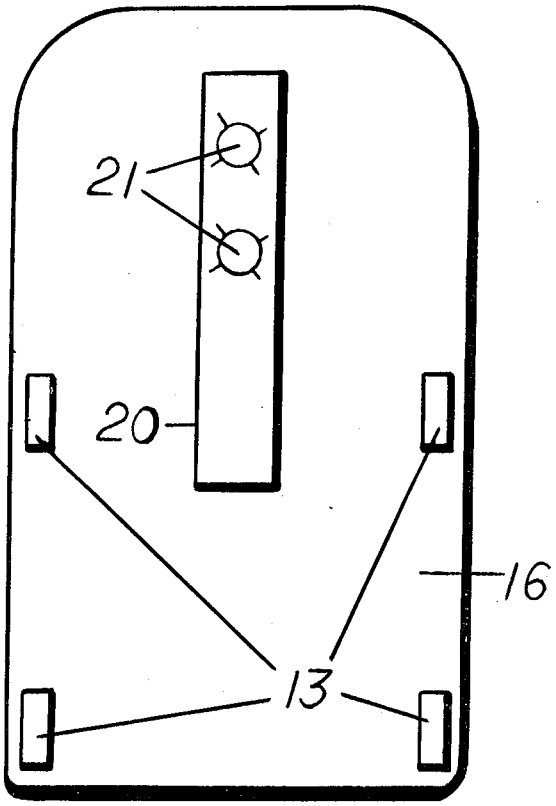
FIG. 11 is a plan view of the base support 16 of shoulder rest 3.

FIG. 11 is the plan view of base 16 of shoulder rest 3. When FIG. 11 is considered in conjunction with FIG. 13 note that the cutout in base 16 is identified with the number 20 and is now stated to be slightly wider than the mating portion of fastener 17 identified by the number 13 in FIG. 13. This configuration allows rotatability of shoulder rest 3 about a vertical axis in a limited manner. Likewise, said cutout 20 is stated to be considerably longer than the mating portion of fastener 17, allowing movement of shoulder rest 3 closer to or farther from head rest 2. The number 21 identifies the two slotted holes in the body rest base 1 into which the spherical ended extensions of fastener 17 presses, stabilizing said fastener, and securing shoulder rest 3 to upper body rest base 1.

Figure 12:
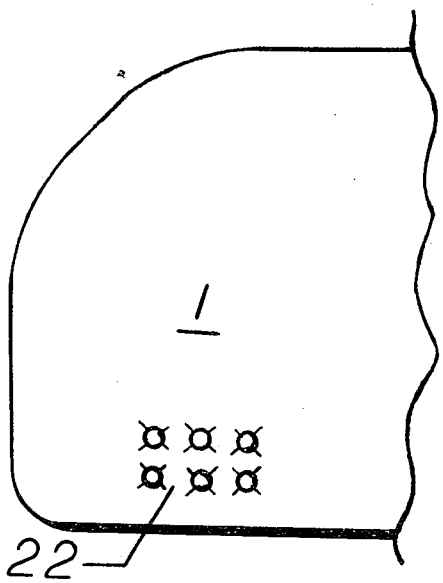
FIG. 12 is a plan view of a portion of base 1 of the upper body rest.

FIG. 12 is a plan view of a portion of the left side of base 1 of the upper body rest showing a pattern of six slotted holes identified with the number 22. Fastener member 17 presses into two of the six holes shown, using one hole toward the rear of the base 1 and one directly forward, toward the front or top. This configuration allows shoulder rest 3 to be secured to base 1 in three different locations, nearer to or farther from the other shoulder rest 3. This means of attachment is typical for the right shoulder rest 3 which is not shown.

Figure 13:
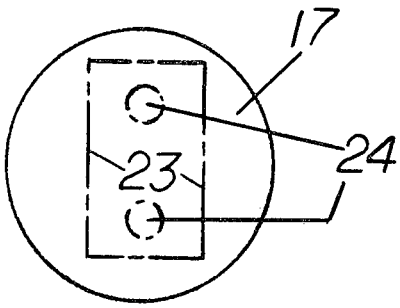
FIG. 13 is a plan view of a fastener used to secure the shoulder rest base 16 to the body rest base 1.

FIG. 13 is a plan view of fastener 17 and when considered in conjunction with FIG. 8, shown are two spherical ended extensions identified by the number 24, a shoulder identified by the number 23 and a larger circular top portion which holds holds base 16 of rest 3 to the upper body rest base 1 in a relatively loose manner.

What is claimed:

1. An adjustable upper body rest for the head and shoulder portion of the human body in a predetermined position and comprising:

a. a base member, b. a pair of laterally spaced apart resilient shoulder support members supported on plastic support forms adapted to support the shoulders of a human body in a predetermined position, c. each of said shoulder support members being so attached to allow limited lateral and longitudinal movement relative to the base and allow complete removability from the said base, d. each of said shoulder support members being so attached to allow limited rotational movement around a vertical axis, e. each of said shoulder support members being configured in a convex manner widthwise at the tops or resting surfaces for a short distance at the ends nearest the head rest and configured in a concave manner widthwise for a longer distance at the opposite ends, f. each of said shoulder support members being so attached to allow positioning at a lower or higher elevation in a stabilized manner by the use of slight pressure of the human hand, g. covers for said shoulder support members made completely or partially of cloth, thin plastic or the like, h. each of said shoulder support members being concave widthwise at the central portions and the outer edge portions sloping downward somewhat similar to a modified printed capital letter "M", i. either of the two shoulder support members providing an adequate arm rest at one of two desireable elevations when the opposite shoulder support member is providing a head rest at one of the two desireable elevations, j. each of said shoulder support members containing recesses or holes in the resilient material and plastic support form to allow sounds of a radio or radio speaker that may be fitted alternately to the underneath side of the plastic support form, to reach the ear of the user, k. a head support member or resilient material supported on a plastic support form centrally located between the two shoulder support members but forward and toward the top of the base of the upper body rest, l. said head support member configured to be concave laterally and longitudinally and resembling an elongated dish and configured so the resilient material and the plastic support form contains recesses in two places at the opposite edges nearer the top end to allow sounds of a radio or radio speaker that alternately may be fitted to the underneath side of the plastic form to reach the ear of the user, as well as to provide relief of pressure on the user's eye which would be present if there were not recesses in the resilient material, m. said head rest being higher at the forward end and extended considerably beyond the base of the upper body rest to prevent contact of less resilient areas of the upper body rest with a headboard of a bed, the user's arms or such other worrisome encounters, n. said head rest being rotatable that rotates about a near horizontal axis in a limited manner which is approximately thirty degrees below a horizontal plane to the left and to the right sides, o. said head support member being removeable from the base member or re-installed by use of modest pressure at the two ends, p. said head rest being rounded areas to preclude damage to the user in the unlikely event that the head rest should become disengaged.

2. The device of claim 1, wherein one or more of the resilient rest members has an inflatable bladder core of rubber, plastic or the like and adapted to be filled to various sizes thereof with liquids, crushed ice, air, or other fluids.

3. The device of claim 2 wherein said core is provided with a suitable cover of polyurethane or the like, as well as cloth,.

4. The device of claim 1 wherein exposed semi-firm support surfaces are covered with a resilient material such as polyurethane or the like to protect the user from injury.

5. The device of claim 4 wherein said polyurethane or the like is in turn covered with thin plastic, cloth or the like.

* * * * *